United States Patent [19]

Ristvedt et al.

[11] Patent Number: 4,731,043

[45] Date of Patent: Mar. 15, 1988

[54] COIN SORTER

[75] Inventors: Victor G. Ristvedt; Mark E. Ristvedt, both of Manchester, Tenn.

[73] Assignee: Ristvedt-Johnson, Inc., Mt. Prospect, Ill.

[21] Appl. No.: 9,111

[22] Filed: Jan. 28, 1987

Related U.S. Application Data

[63] Continuation of Ser. No. 872,629, Jun. 9, 1986, abandoned, which is a continuation of Ser. No. 561,722, Dec. 14, 1983, abandoned.

[51] Int. Cl.[4] ..... G07D 3/16

[52] U.S. Cl. ..... 453/6; 453/57

[58] Field of Search ..... 133/3 C, 3 A, 3 B, 3 H, 133/3 R

[56] References Cited

U.S. PATENT DOCUMENTS

| | | | |
|---|---|---|---|
| 574,528 | 1/1897 | Elder et al. | 133/3 C |
| 2,835,260 | 5/1958 | Buchholz | 133/8 |
| 2,906,276 | 9/1959 | Blanchette et al. | 133/3 A |
| 4,086,928 | 5/1978 | Ristvedt et al. | 133/3 A |
| 4,098,280 | 7/1978 | Ristvedt et al. | 133/3 A |
| 4,111,216 | 9/1978 | Brisebarre | 133/3 A |
| 4,234,003 | 11/1980 | Ristvedt et al. | 133/3 A |
| 4,360,034 | 11/1982 | Davila et al. | 133/3 A |
| 4,444,212 | 4/1984 | Ristvedt et al. | 133/3 A |
| 4,506,685 | 3/1985 | Childers et al. | 133/3 A |
| 4,531,531 | 7/1985 | Johnson et al. | 133/3 A |
| 4,543,969 | 10/1985 | Rasmussen | 133/3 A |
| 4,564,037 | 1/1986 | Childers et al. | 133/3 A |

FOREIGN PATENT DOCUMENTS

| | | | |
|---|---|---|---|
| 1137884 | 10/1962 | Fed. Rep. of Germany | 133/3 A |
| 2515837 | 10/1975 | Fed. Rep. of Germany | 133/3 C |
| 2296361 | 8/1976 | France | 133/3 C |

*Primary Examiner*—Charles J. Myhre
*Assistant Examiner*—David A. Okonsky
*Attorney, Agent, or Firm*—Stephen G. Rudisill

[57] ABSTRACT

A coin sorter of the type wherein coins are sorted by the combination of a sorting head and rotated resilient disc in which the inner edge of the coins are radially referenced as they rotate, and coins of a discrete diameter of ejected at discrete circumferential points by a series of ramp-slot combinations in which the radially positioned ramp depresses a discrete diameter of coin into a slot. The slots are configured to direct coins caught in a slot outward.

39 Claims, 12 Drawing Figures

COIN SORTER

This is a continuation of application Ser. No. 872,629, filed on June 9, 1986, now abandoned which in turn is a continuation of application Ser. No. 561,722, filed on Dec. 14, 1983 and now abandoned.

TECHNICAL FIELD

This invention relates generally to coin handling equipment, and particularly to a high-speed coin sorter.

BACKGROUND ART

Prior U.S. Pat. Nos. 4,086,928 and 4,098,280 illustrate what the applicant regards as the most pertinent prior art. In both instances, these patents disclose coin sorters which employ annular sorting heads positioned over and adjacent to a rotating disc having a resilient pad, coins being introduced through a central opening in the sorting head. The underside of the sorting head is configured to effect a single file of coins which spirals outward to a radial position where, in accordance with U.S. Pat. No. 4,086,928, an inner facing edge of a peripheral guide on the disc causes the outer edge of coins to be referenced at a discrete radial position. In the case of U.S. Pat. No. 4,098,280, the peripheral guide is moved on the head. Beyond the peripheral guide, the coins are rotated to circumferentially spaced coin sorting devices. In the case of U.S. Pat. No. 4,086,928, these devices consist of a series of wheels which are positioned to press down on the inner edges of coins, passing them into the resilient disc. When this is done, the outer edge of a coin rises, and it is flung over the edge of the peripheral guide at the circumferential point where that wheel is located. Each of the sorting wheels is located at a different radial position, each being adapted to engage the inner edge of a particular diameter coin and thus cause it to be flung outward at the particular location of that wheel. Logically, the first of the wheel depressors is positioned at the shortest radial position in order to engage the largest of the coins to be sorted. The other depressing wheels are positioned at progressively longer radial positions to thereby progressively sort smaller coins.

The system of U.S. Pat. No. 4,098,280 employs a quite different type of sorting devices, these consisting of a series of recesses spaced around the periphery of the sorter, and wherein each has an inner edge located at a different discrete radial position and each recess functions to release a coin from radial retention. Since, as in the case of the sorter of the first patent, the coins have their outer edges indexed to a common reference, a discrete one of the recesses is positionable to free a discrete size coin and enable it to be released and discharged by centrifugal force at a discrete circumferential position. Thus, sorting occurs in a reverse order to that of the system of the first patent in that the smallest coin is intercepted and sorted first. Both of the sorters have gained wide acceptance and are at this time the only two types of really high-speed (in excess of 3,500 coins per minute) coin sorters on the market.

It has been determined that there are two aspects of these prior art sorters which, if corrected or improved, would provide a materially improved coin sorter. The first one deals with the interruption or stopping of the machine while there are coins in the machine. When this is done, neither of the existing machines can accurately resume operation. A second feature of the two sorters, particularly with respect to the first of them, is that of criticality of adjustment of the proximity of the sorting head to the rotating disc.

The applicant has considered these, and it is the object of the present invention to provide a new and improved high-speed coin sorter in which the sorting of a batch of coins can be interrupted without inaccuracy in sorting or counting of discrete denominations of coins and at the same time increase the tolerance of adjustment of the sorting head.

SUMMARY OF THE INVENTION

In accordance with this invention, an annular guide plate is positioned closely adjacent to a rotating circular coin carrying disc having a resilient, generally flat, horizontal surface. A guide plate is configured with a complex surface or recesses and with edges which direct the movement of coins from the center of the guide plate to circumferentially spaced coin ejection assemblies about the periphery of the guide plate. A first recess forms coins in a single file and directs the coins outward in a spiral. Thereafter, the recess of reduced depth radially captures coins, and an outer facing edge of this recess urges the inner edge of coins outward to a fixed radial, reference, position. No peripheral limit is employed, and thus the outer edge of each coin is positioned at a radial position which is a function of the diameter of that coin. The coins are then rotated at this radial position wherein the inner edge of coins of all diameters retains a fixed radial position through a series of selected coin ejection assemblies. These ejection assemblies progressively intercept the largest to the smallest diameter of coins and remove them from the disc at discrete spaced positions around the disc. Each of these ejection assemblies includes an outwardly extending tapered slot which extends across the path of the inner diameter edge of coins. These slots are all at essentially the same radial position and are configured such that a coin lying flat on the resilient surface of the disc will pass over the slots. Sorting is effected by a series of coin depressors, one outboard of each slot, which depress the outer edge of different size coins, with the result that the resilient disc causes the inner edge of a coin to rise into a slot. When this occurs, the rotational force of the disc on that coin will force it outward as guided by the slot. Each coin depressor is spaced from a slot to intercept and depress one discrete size coin and cause it to be ejected at a discrete radial position and thereby be sorted.

DETAILED DESCRIPTION OF THE DRAWINGS

Figure 1:
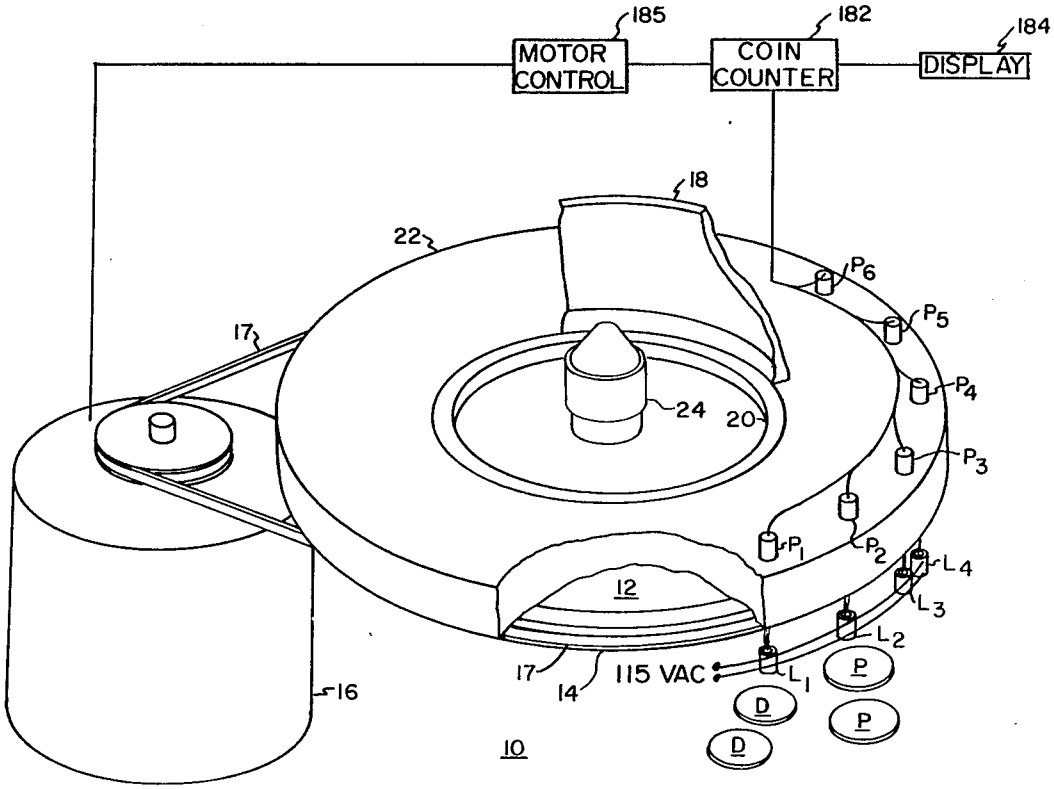
FIG. 1 is a pictorial view of the basic configuration of an embodiment of the invention.
Figure 6:
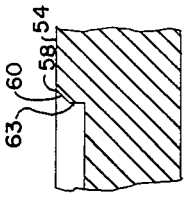
FIGS. 5–12 are sectional views taken along like numbered lines of FIG. 2.
Figure 7:
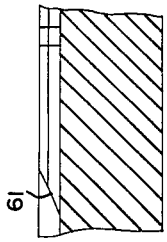

Referring initially to FIG. 1, basically, sorter 10 employs a resilient disc in the form of pad 12 of an elastomer construction rotated on and by a turntable 14 driven by motor 16 via belt 17. A hopper 18 (partially broken away) is positioned about an opening 20 in guide plate 22, and coins to be sorted are inserted through this hopper. Guide plate 22 is supported, by means not shown, at a selected spacing with respect to pad 12, typically 0.005 to 0.010 inch. A centrally positioned hub 24 extends through an opening (not shown) in pad 12 and is conventionally secured as by a threaded connection to turntable 14. Hub 24 has a tapered surface which functions to direct coins in an off-center direction so that there will always be some centrifugal force tending to cause coins to move outward toward guide plate 22.

Referring now additionally to FIGS. 2–12, the underside of guide plate 22 is configured to guide coins rotated by pad 12 to move in the direction of the arrow (FIGS. 2, 3 and 4) in a circular and then spiral path outward within an inner positioned recess 34 which overall is oval in configuration and has an inner guide, or guide edge 30, which extends around it. The coins are moved, as illustrated by coins 26, outward by centrifugal force; and, as illustrated by coins 28, are moved in a path governed by tapered inner facing edge 30 of recess 34, this recess having, in general, a depth on the order of 0.005 to 0.010 inch deeper than the thickest coin to be sorted. Thus, the coins are free on the top surface of recess 34. The first part of their travel is generally circular from point 38 to point 40 and during it the coins are formed in a single file.

At approximately point 40 (FIG. 3), edge 30 of central portion 35 of recess 34 transitions, in a recess portion 44, from being circular to a spiral, and thereafter coins are moved outward, along edge 42, by the combination of circular movement of pad 12 and centrifugal force. Recess region 44 may be of the same depth or slightly shallower than other portions of recess 34, the latter being the case where the thickness of the thickest coin to be sorted is greater than the thickness of two of the thinnest coins to be sorted. In all cases, the depth would be slightly less than the thickness of the two thinnest coins to be sorted, typically 0.010 to 0.020 inch less in depth. Where it is necessary to provide reduced depth, there would be a gradual transition or slight ramp downward between central portion 35 of recess 34 and recess region or portion 44 and downwardly between recess region 44 and region 67 (the transition being in the region between the spaced dashed lines), with reference to a counterclockwise direction of FIG. 3. This dimension in recess portion 44 is required in order to separate two thin coins, such as illustrated by coins 50 and 52 (FIG. 4), when they have assumed a position where one coin is on top of the other, as shown.

Separation is effected by a guide 54 (FIGS. 6 and 7) as follows. With the depth of recess region 44 less than the thickness of the two piggyback coins 50 and 52, the bottom coin 50 would be frictionally engaged by pad 12 (FIG. 1) and moved over an upper tapered portion 60 (FIGS. 2 and 6) of guide edge 58 in a circle as indicated by the path of this coin as depicted by dashed line positions of this coin, the first position being indicated by the suffix "a." Thereafter, as shown with coin position suffix "b," the coin has moved back into recess 34. Finally, as shown by coin position suffix "c," the coin is free of compression in recess 34, enabling it to be simply recirculated around on pad 12. The upper of the coins, coin 52, is restrained by an upper flat portion 63 (FIG. 6) of edge 58 of guide 54, and this coin passes outboard of guide 54. Guide 54 fully tapers (FIG. 7) at point 61 from recess 44 to the bottom surface 65 of guide 64 such that a coin striking this point simply rides over guide 54 and is recirculated.

Figure 8:
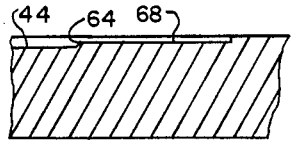
Figure 5:
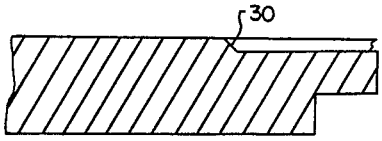
Figure 9:
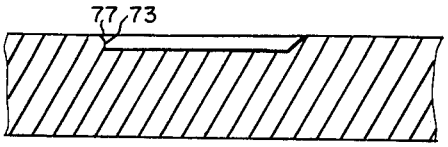

Recess portion 44 also forms a restricted passageway for a single file of small coins, for example, pennies and dimes of U.S. coinage. This passageway is formed between outward projection 62 of guide 54 and edge 64 of recess 44. Edge 30 and its extension 64 are both tapered as shown in FIGS. 5 and 8, this taper effecting a wedging action of coins to prevent bounce.

Larger coins (e.g., a nickel, quarter, Susan B. Anthony dollar, or half dollar), such as illustrated by coin 66 (FIG. 4) actually cartwheel outward into recessed area 68 and thereby move around guide edge 62 until they are moved circularly beyond recess portion 44 (FIG. 3) of recess 34 where they are free to move outwardly by centrifugal force. Recess 68 (FIG. 8) is of less depth than recess 34 (or recess portion 44). As a result, the larger coins are actually captured by pad 12 and rotated by it. The outer edge region 69 of guide 54 lies generally in a fixed radial configuration in order to enable a sufficiently large area of recess 34 to accommodate free movement of coins by centrifugal force. As a result, the larger coins, and, of course, the smaller ones also, move outward along spiralling edge 42 to a generally circular edge 72, as illustrated by coin 71.

In the event that a coin is, for some reason, on top of another coin within area 67 of recess 34, edge 78 (FIG. 9) of guide 54, having an upper straight edge region 72 and lower tapered edge 77, will effect a separation of the coins, causing the lower of the coins to be moved over guide 54 as described for the separation and movement of coins 50 and 52. Edge 78 breaks up any jams that may form between coins, as by doubling, and captures any coins moved against edge 78 and causes them to be recirculated back into recess 34 for reforming in a single file.

Figure 4:
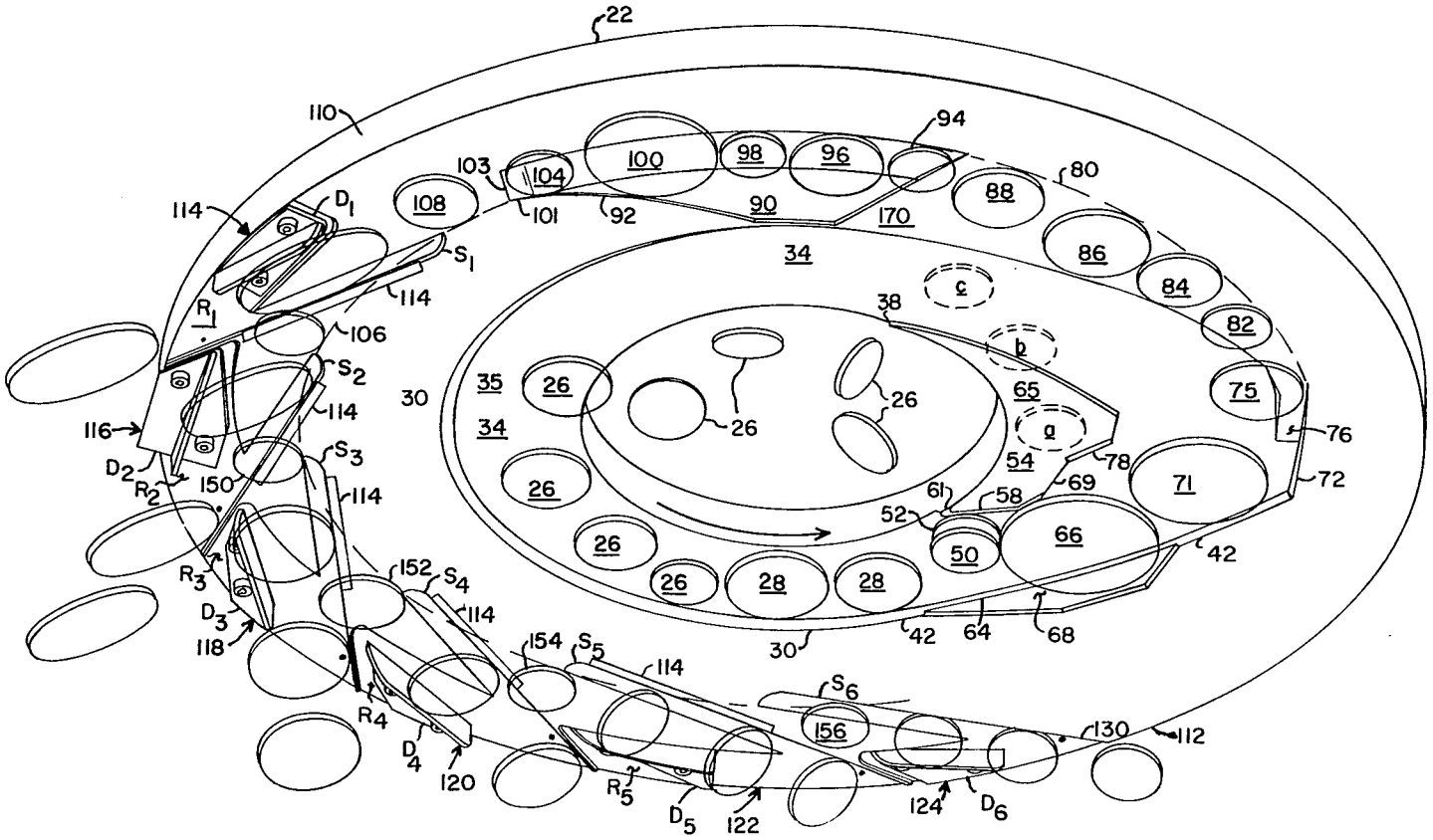
FIG. 4 is a pictorial view like that of FIG. 3 except that there is added an illustration of the movement of coins with respect to the guide plate lines of FIG. 2.
Figure 10:
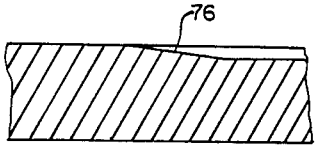

Freely moving coins finally form in a single file, as illustrated by coin 75, and are rotated by pad 12 to a position where they engage downwardly extending ramp 76 (FIG. 10) and illustrated by the position of coin 75. As a result, ramp 76 effects a depression of coins into pad 12. In this manner, coins are captured at their then radial position (FIG. 4). Dashed line 80 indicates a maximum diameter circular path along which coins may progress, as shown by coins 82, 84, 86 and 88. This path may be inward somewhat depending upon where the coins are captured by ramp 76.

Figure 11:
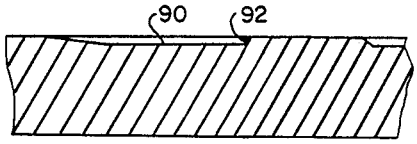

Coins are next rotated into a tapered recess 90, the contour of which is illustrated in FIG. 11. Most significantly, recess 90 is tapered upward and inward and includes outwardly curving coin positioning edge 92. Coins 94, 96, 98 and 100 are shown as being within recess 90 along the circular path of dashed line 80 until, as indicated by coin 100, this coin is rotated to a position where its inner edge engages edge 92 of recess 90. When this occurs, a coin 100 is urged outward along edge 92 to point 101 where edge 92 merges into ramp 103. Ramp 103 is configured like ramp 76 shown in FIG. 10, and this functions to urge a coin downward, as would be the case for coin 104. Thereafter, coins are rotated with their inner edge radially referenced to this point. Dashed line 106 illustrates this path of rotation, and coin 108 illustrates a coin following it. Significantly, this means that the outer edges of the coins traverse a circular path which is uniquely determined by their diameter. It follows that a circular path of the outer edge of a half dollar is at a larger radius of rotation than smaller diameter coins.

Figure 12:
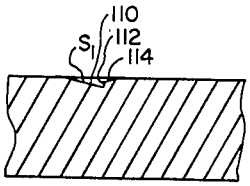

Next, the coins, referenced as described, are rotated through a peripheral area from point 110 to point 112 containing a plurality of coin ejection assemblies which are each distinctively configured to eject a discrete diameter of coin, the largest being ejected first. In accordance with U.S. coinage, ejection assembly 114 is adapted to eject half dollars, assembly 118 to eject quarters, assembly 120 to eject nickels, assembly 122 to eject pennies, and assembly 124 to eject dimes. Each assembly includes a beveled slot, these being slots S1–S6, and each intersects dashed line 106, marking the rotational path of the inner edge of a coin, and which is the same for all coins. The slots extend in an outward direction and wherein the line of direction bears an angle with respect to a radial line in the approximate range of from 70° to 90°. Slot S1 is illustrated in FIG. 12, it having a sloping base region 110 of a slope of approximately 30°, an inner edge indexing wall 112, and a small and downward sloped region 114, the latter having a maximum depth of approximately 0.009 inch and being of a slope of approximately 5°. All of the slots are alike to the extent of their radial position, and, in general, their angular orientations are alike with respect to dashed line 106. Slots S1–S6 do not have a selective effect on coins and, in fact, they are configured such that, unless a coin is particularly raised into a slot, as will be described, that coin will simply pass over a slot.

Coin sorting is effected by selective lateral ejection at discrete circumferential positions around guide plate 22 and is effected by a series of ramp-shaped depressors D1–D6 which, in this embodiment, are attached within a series of recesses R1–R6 extending around guide plate 22. Wall regions W1–W5 (FIG. 3) separate recesses R1–R6, and a coin facing edge of each forms an extension of a like facing edge of like numbers of slots S1–S5 which, in effect, extend edges of the slots our to the periphery of guide plate 22. An edge 130 of recess R6 provides a like extension of the coin engaging edge of slot S6.

Each of depressors D1–D6 are basically alike, and each extends outward generally parallel with a like numbered slot. However, each is uniquely radially positioned, and its inner edge is positioned to engage the outer diameter region of one size coin as that coin moves circularly around guide plate 22 with its inner edge along dashed line 106. When a coin is so engaged, its outer edge is pressed downward, generally outboard of pad 12, and resilient pad 12 presses the inner edge of that coin upward. When this occurs, the inner edge of the coin is captured by a slot, preventing continued circular motion, but, as a result of the circular force of the pad on the coin, the coin is forced along the direction of that slot outward and is thus ejected at a selected exit position E1–E6 (FIG. 1) around guide plate 22. As indicated above, the depressors are placed at different distances outboard of their associated slots, and thus a different distance outboard from dashed line 106, marking the travel of the inner edge of each coin. Depressor D1 has a maximum spacing from dashed line 106 and is adapted to intercept the largest diameter coin to be sorted, a half dollar, and progressively, depressors D2-D6 are arranged to intercept, in order, progressively smaller coins to be sorted; thus, Susan B. Anthony dollars, quarters, nickels, pennies and dimes, in that order, and exist at the numbered exit positions E1–E6. The radial distance from dashed line 106 (FIGS. 3 and 4) to the leading edge 140 of a depressor is approximately 0.015 inch less than the diameter of the coins to be intercepted. Coins 150, 152, 154 and 156 are shown passing uneffected over various slots pending their reaching a slot where their circular motion would be arrested by being lifted into a discrete slot as described.

Slots S1–S5 have sloped or beveled areas 114, shown in FIG. 12, and these are included to prevent the capture and premature ejection of a coin which is bent or has a ragged edge which might tend to be caught by a slot without having been forced into it by a coin depressor. This tapered region enables a generally flat coin, but one with a ragged edge, to ride over a slot until it is, in accordance with its diameter, depressed by one of the depressors into a slot. This tapered region is omitted in slot S6 as, in operation, slot 6 should eject the only coin reaching it, which would be the smallest coin being sorted regardless of its condition.

While operation has generally been described above, it will be reviewed. First, coins of different diameters to be sorted would be placed in hopper 18, and thus they would rest against pad 12. When motor 16 is started, pad 12 would rotate in the direction of the arrow, and coins would be moved by centrifugal force outward and in recess 34 where they basically form in a single file against guide edge 30. They would then be moved in the direction of the arrow outward where any doubled small coins, e.g., dimes, would be separated by the capturing of the lower one and moving it under guide 54. Smaller denomination coins, such as dimes and pennies, would pass outward of the guide within recess portion 44 and between guide 54 and guide edge 64. Larger coins would be enabled to pass by a reduced depth recessed area 68 within which the larger coins (e.g., coin 66) would effectively cartwheel outward and then be rotated back into the full depth recess of recess 67. Coins in recess 67 freely move outward by centrifugal force as in the case for coin 71. In case there exists in this recess doubled coins, one coin on top of the other, the coins would be separated by edge 78, enabling the lower of the coins to pass under edge 78.

A coin normally passing outward within recess 67 would be stopped by edge 72 and rotated under ramp 76 which would then effect a capturing of a coin, as would be the case with coin 75. Coins so captured, as in the case with preceding coins 82, 84, 86 and 88, would be rotated. Beyond point 170, the coins would pass under a recessed area 90. It is of less depth than recessed area 34, and thus coins would continue to be captured but would be readily susceptible to radial movement when engaged by edge 92 of recess 90. Outer movement would be effected by a coin, as on coins 100 and 104 by edge 92 until a coin, as shown by coin 104, is moved to an outer reference diameter, marked by dashed line 106. At this point, coins are depressed further downward by ramp 103 and fully captured by the lower surface of guide plate 22, as would be the case for coin 108. Coin 108 and coins which have preceded it would be intercepted by depressors D1–D6 as described, and whereby coins are ejected from the sorter, with the largest coin being ejected by ejector assembly 114 and the smallest by ejector assembly 124.

Figure 2:
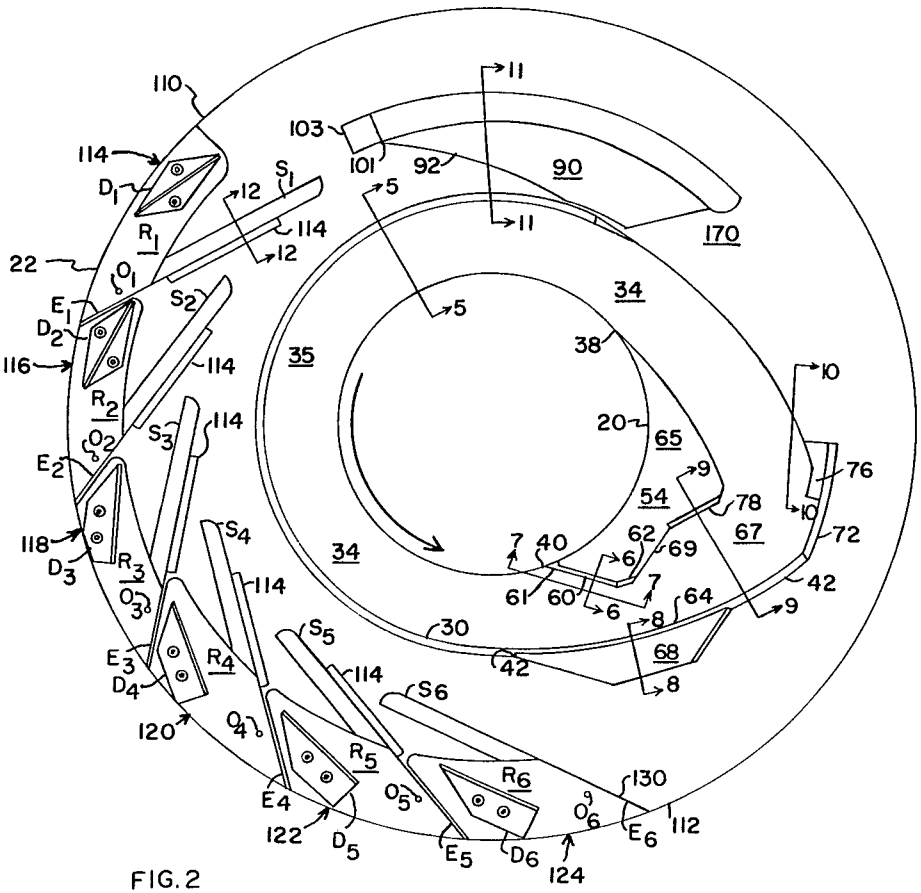
FIG. 2 is a bottom view of a guide plate of the invention which controls the movement of coins.
Figure 3:
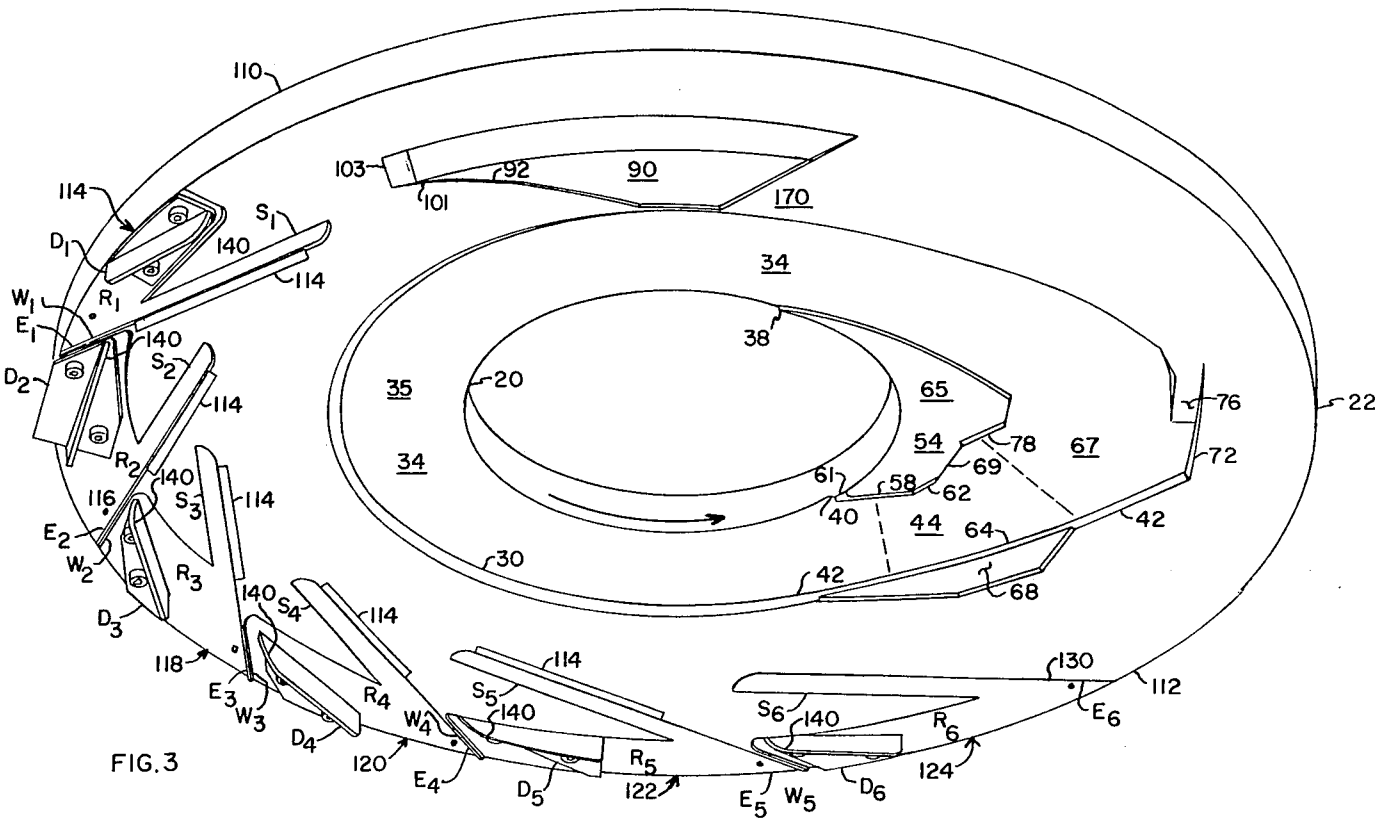
FIG. 3 is a pictorial view of the underside of the guide plate.

Coins are photoelectrically detected for discrete counting of each denomination by photosensors P1–P6 (FIG. 1) positioned on the top of guide plate 22 just above an opening, indicated by openings O1–O6 shown in FIG. 2. A series of lights L1–L4 (only four shown in FIG. 1), one under each opening, are supported on a frame (not shown) just outboard of pad 12; and when a coin passes across one of the openings, the light sensed by the photodetector is blocked. The condition of light or dark is provided by an output of the photosensors to coin counter 182, which is adapted to be responsive to the occurrence of a dark state for effecting a count. Counter 182 is otherwise conventional in that it would include an electrical counter operating responsive to each photosensor and electrically provide a count of coins passing a photocell. Counter 182 would also typically include computation means for computing the dollar (or other denominator) value coins of each denomination and the total value of all coins sorted and counted. The output of counter 182 would be fed to, and displayed on, a conventional digital display 184.

Additionally, means are provided to stop the sorting process when a selected number of coins of any denomination has been ejected or sorted, as may be the case for one of the sets of denominations of coins indicated by coins D and P as shown in FIG. 1. Further, stopping may be accomplished without error of sorting or counting of each batch of coins sorted even through the sorter is stopped between batches. Batch counting, that is, counting up to a selected number of coins in hopper 18 and stopping, is accomplished by means of a feature of coin counter 182. It would include conventional means for entering a selected count of a selected denomination of coins; and when that number has been accounted for, counter 182 would provide an electrical output, this output being fed to motor control 185. Motor control 185 would include circuit means for instantly applying a braking potential to motor 16 (an A.C. induction motor) in place of a running potential. One method of providing a braking potential is to provide a D.C. bias to motor 16. As one means of supplying a direct current stopping potential, a rectifier circuit would convert alternating current input into direct current, and this direct current would be used as a charging potential for a character. Upon a selected input to motor control 185, motor control 185 would switch the input of motor 16 from a conventional alternating current input to one where the capacitor is connected across the motor. This would enable a high inrush of direct current to motor 16 and quickly bring it to a halt. To assist this process, typically, the D.C charging circuit would be such as to provide on the order of 1/5 the normal running A.C. current in the form of direct current to the motor for a brief interval following the switching in of the capacitor. This further assures a rapid and resistant braking of motor 16.

The braking of motor 16 and thereby the interruption of the sorting process with coins still in hopper 18 is a particular feature of this invention inasmuch as in other high-speed coin sorters, it is not feasible inasmuch as it has not been previously possible to stop and then start the sorting process with accuracy. The present invention has overcome this problem, enabling any selected number of any selected denomination of coin to be dispensed, then the sorter restarted and any denomination be again accurately dispensed.

I claim:

1. A coin sorter for sorting coins in terms of their diameter comprising:

a horizontally positioned circular coin carrying disc having a resilient top surface onto which coins may be fed;

a guide plate having a central circular opening and a configured lower surface positioned over and closely adjacent to said disc, and wherein said configured surface includes an arcuate central recess within which coins are free to move radially, and said central recess generally extends outward from said central opening and having an outer edge which extends outward in a spiral, along which coins form in a single file;

coin positioning means including a second recess, of lesser depth than said central recess, positioned to intercept coins rotated by said disc from said central recess, and said second recess having an outwardly extending, outwardly facing edge positioned to intercept an inner positioned edge of coins and urge said coins outward for radially positioning with their inner edge at a fixed diametric position;

a plurality of coin ejection assemblies positioned circumferentially around said guide plate generally along a circular path traversed by coins rotated by said disc from said coin positioning means, and wherein each said coin ejection assembly comprises:

an outwardly extending slot in said guide plate positioned to intercept said path, and depression means positioned outside of and generally parallel with each said slot, and wherein each said depression means comprises a ramp configured to engage an outer positioned edge region of one diametric size of coin and thereby pressing the outer edge of the coin downward, and wherein the inner edge of the coin is urged upward by said disc into a said slot, and whereby a combination of circular force applied to the coin and said slot causes the coin to be moved outward as captured by the slot and ejected; and wherein a depression means of each ejection assembly is positioned at a discrete spacing from a said slot, whereby with graduately smaller spacings for slot-ramp combinations as they appear around the disc in a direction of rotation, a large coin is ejected first, and smaller coins are ejected in an order of their diminishing size.

2. A coin sorter as set forth in claim 1 including radial capture means positioned to intercept coins moving between said central recess and said coin positioning means and including a gradually diminishing recess extending generally circular from said central recess, whereby coins transiting said gradually diminishing recess are pressed between said guide plate and said disc and rotated by said disc at a fixed radial position to said coin positioning means.

3. A coin sorter as set forth in claim 2 wherein said central recess includes a generally circular inner region and a spiral region extending outward from said inner region, and wherein coins fed through said opening initially are guided by said inner region and then move outward through said spiral-shaped region to said radial capture means, and wherein at least a portion of said spiral-shaped region is of a selected depth.

4. A coin sorter as set forth in claim 3 wherein said guide plate includes an anti-shingling guide extending outward from said central opening in a region of said spiral-shaped region, reducing the width of said spiral-shaped region, and said guide having a leading edge with a lower tapered surface whereby:

two shingled coins, which together have a thickness of greater than said selected depth, are radially captured between said guide plate and said disc and are circularly rotated to and against said leading edge;

a lower of the two shingled coins is rotated under said leading edge of said guide; and an upper of said shingled coins is radially freed and is thereby moved by said disc and centrifugal force outward within said spiral-shaped region of said second recess out to said coin positioning means.

5. A coin sorter as set forth in claim 4 including a third recess of lesser depth than said central recess and extending outward from a portion of said spiral-shaped region of said central recess, opposite to said guide, whereby coins of a diameter greater than a minimum width of said spiral-shaped region, occurring opposite to said guide, may cartwheel out into said third recess and pass around said guide as they are moved outward toward said radial capture means.

6. A coin sorter as set forth in claim 5 wherein said guide includes a second tapered edge region adjacent to a portion of said spiral-shaped region of said central recess which is between said second recess and said radial capture means, whereby the lower of any two shingled coins present is rotated under said second tapered edge, freeing the upper coin to move radially and circularly onto said radial capture means.

7. A coin sorter as set forth in claim 1 wherein said depression means comprises ramps generally positioned radially outside said disc.

8. A coin sorter as set forth in claim 1 further comprising counting means for selectively counting coins ejected along the path of each slot.

9. A coin sorter as set forth in claim 8 including an electrical motor coupled to apply a rotational force to said disc and braking means responsive to a count of a selected number of coins from said counting means for stopping said motor and thereby interrupting sorting when a selected number of coins of a selected denomination have been dispensed by the sorter.

10. A coin handling machine for separately dispensing coins of different diameters comprising:

a horizontally positioned circular coin carrying disc having a top surface to which coins may be fed and having at least an annular area of said surface which is resilient;

means for rotating said disc;

guide means positioned over said disc and including a generally spiral-shaped recess having an outwardly facing guide surface for horizontally positioning coins in a single file on a disc with an inner edge of all coins, regardless of their diameters, located at a common radial position so that an outer edge of the coins traverse arcuate paths uniquely determined by the diameters of the coins; and ejection means adapted to engage an outer portion of the coins along said arcuate paths uniquely determined by the diameters of the coins for ejecting from said disc the coins of one diameter at one circumferential position and the coins of at least one other diameter at a second circumferential position.

11. A coin handling machine as set forth in claim 10 wherein said ejection means comprises a plurality of coin ejection assemblies positioned over and around said disc, and wherein a coin ejection assembly comprises:

an outwardly extending slot leading to the periphery of said disc and positioned to be above an inner edge region of a coin as it is rotated by said disc from said guide means; and depression means including one discrete coin depressor positioned outside of an generally parallel with each said slot, and wherein each said depressor is positioned and configured to engage an outer positioned edge region of one diametric size of coin, thereby depressing the outer edge of that coin downward, wherein the inner edge of that coin is urged upward by a resilient surface of said disc into a said slot, and whereby the combination of centrifugal force and said slot causes a coin to be moved outward and ejected.

12. A coin handling machine as set forth in claim 11 wherein each said depressor is positioned at a discrete spacing from a said slot whereby with gradually smaller spacing for slot-depressor combinations as they appear around the disc in the direction of rotation, a large coin is ejected first and smaller coins are ejected on the order of their dimension size.

13. A coin handling machine as set forth in claim 10 wherein said guide plate has a diameter larger than a diameter of said coin-carrying disc, and said ejection means are mounted on said guide plate beyond an outer edge of said disc.

14. A coin handling machine as set forth in claim 11 wherein said guide plate has a diameter larger than a diameter of said coin-carrying disc, and said coin depressors are mounted on said guide plate beyond an outer edge of said disc.

15. A coin handling machine comprising:

a horizontally positioned circular coin carrying disc having a resilient top surface onto which coins may be fed; and a guide plate having a central circular opening and a configured lower surface positioned over and closely adjacent to said disc, and wherein said configured surface includes an arcuate central recess within which coins are free to move radially outward, and said central recess generally extends outward from said central opening and having an outer edge which extends outward in a spiral, said guide plate forming a single-file composing recess having a first region with a radial dimension that passes only coin denominations having a first size, and a second region extending radially outwardly from said first region for passing coin denominations having a second size larger in diameter than said just size, said first and second regions having different depths so that said first-size coins are retained in said first region, the outer edges of said first and second regions converging with each other at downstream ends thereof so that the coins passed through said regions are located with their outer edges at a common radial position.

16. A coin handling machine as set forth in claim 15 wherein an inner edge of said first region guides the coins radially outwardly as the coins are moved circumferentially through said first region.

17. A coin handling machine as set forth in claim 15 wherein said guide plate forms a recess extending radially inwardly from the converged outer edges of said first and second regions and deep enough to allow coins of all denominations to move by centrifugal force against the outer edge thereof.

18. A coin handling machine comprising:

a horizontally positioned circular coin carrying disc having a resilient top surface onto which coins may be fed; and a guide plate having a central circular opening and a configured lower surface positioned over and closely adjacent to said disc, and wherein said configured surface includes an arcuate central recess within which the coins are free to move radially outward, and said central recess generally extends outward from said central opening and having an outer edge which extends outward in a spiral, said guide plate forming a composing recess for receiving coins from said central recess and having an inner edge for guiding the coins radially outwardly as the coins are moved circumferentially through said composing recess, an upper portion of said inner edge being substantially perpendicular to the surface of said disk and a lower portion of said inner edge being tapered in a direction of said disk, so that engagement of said inner edge by a pair of overlapping coins causes the lower coin to be rotated across the tapered lower portion of said inner edge and recycled to said central recess, while the upper coin is guided along the perpendicular upper portion of said inner edge.

19. A coin handling machine as set forth in claim 18 wherein said composing recess has a depth which is less than twice the thickness of the thinnest coin denominations.

20. A coin sorter for storing coins in terms of their diameter comprising:

a horizontally positioned circular coin-carrying disc having a resilient top surface onto which coins may be fed;

a guide plate having a central circular opening and a configured lower surface positioned over and closely adjacent to said disc, and wherein said configured surface includes an arcuate central recess within which coins are free to move radially, and said central recess generally extends outward from said central opening and having an outer edge which extends outward in a spiral, along which coins form in a single-file, said guide plate forming a referencing recess for receiving the single-file coins and pressing them against the resilient top surface of said coin-carrying disk to inhibit radial movement of said coins as the disk advances the coins circumferentially through said referencing recess, one edge of said referencing recess having a referencing edge which overlies said resilient top surface and engages the edge of each of the advancing coins and positions said edge of each of the coins of all denominations at a common radial location, wherein the diametrically opposite edge of each coin is positioned at a radial location determined by the diameter of the coin; and coin ejection means positioned to engage the diametrically opposite edge portions of the coins that are positioned at radial locations determined by the diameter of the coin, for ejecting said coins of a selected diameter at a selected circumferential location on the guide plate.

21. A coin sorter as set forth in claim 20 wherein said referencing edge is formed by a recess of lesser depth than said central recess.

22. A coin sorter as set forth in claim 20 wherein said referencing edge positions the inner edges of all coins at said common radial location so that the outer edge of each coin is positioned at a radial location determined by the diameter of the coin.

23. A coin sorter for sorting coins in terms of their diameter comprising:

a rotatably mounted coin-carrying disc having a resilient top surface onto which coins may be fed;

a guide plate having a central circular opening and a configured lower surface positioned over and closely adjacent to said disc, and wherein said configured surface includes an arcuate central recess within which coins are free to move radially, and said central recess generally extends outward from said central opening, said guide plate forming a referencing recess for receiving the coins from said central recess and pressing them against the resilient top surface of said coin-carrying disk so that the disk advances the coins circumferentially through said referencing recess, a radially inner edge of said referencing recess engaging radially inner edges of the coins of all denominations and moving said coins radially outwardly as the coins are advanced circumferentially through said recess so that the radially inner edges of the coins of all denominations are positioned at a common radial location, wherein radially outer edges of the coins are positioned at different radial locations determined by the denominations of the respective coins, and sorting means disposed around an outer periphery of said guide plate for sorting coins of different denominations according to said different radial locations of the radially outer edges of the coins of different denominations, said sorting means ejecting coins of a common denomination at a common circumferential location on the periphery of said guide plate.

24. A coin sorter as set forth in claim 23 wherein said central recess includes means for arranging said coins in a single file and a single layer before the coins exit said central recess.

25. A coin sorter as set forth in claim 23 wherein said sorting means includes a series of circumferentially spaced depressors for engaging and depressing the radially outer portions of coin denominations of successively decreasing diameter, and a series of circumferentially spaced recesses formed in said guide plate adjacent each depressor for receiving the radially inner portions of the coins whose radially outer portions are depressed and ejecting said coins from between said disc and said guide plate.

26. A coin sorter as set forth in claim 25 wherein each said circumferentially spaced recess comprises a slot leading to the periphery of said guide plate for guiding the respective coins to said periphery.

27. A coin sorter as set forth in claim 23 wherein:

portions of said guide plate located radially outwardly from said central recess being located close enough to said resilient surface to continuously depress coins of all denominations into said resilient surface to inhibit radial movement of said coins, after leaving said central recess.

28. A coin sorter as set forth in claim 23 wherein said sorting means includes means for camming the coins outwardly until the inner edges of the coins are released from the pressure of said guide plate and resilient surface.

29. A coin handling machine comprising a rotatably mounted coin carrying disc having a resilient top surface onto which coins may be fed, and a guide plate having a central circular opening and a configured lower surface positioned over and closely adjacent to said disc, and wherein said configured surface includes an arcuate recess within which said coins are free to move radially outward, portions of said guide plate located radially outwardly from said central recess being located close enough to said resilient surface to depress coins of all denominations into said resilient surface to inhibit radial movement of said coins, said configured lower surface of said guide plate also forming reference means for engaging the inner edges of the coins of all denominations, after they have exited said central recess, and moving said coins radially outwardly, against the pressure of said guide plate and resilient surface, thereby positioning said coins at desired radial and circumferential locations between said guide plate and resilient surface.

30. A coin handling machine as set forth in claim 29 which includes sorting means disposed around the outer periphery of said guide plate for sorting coins of different denominations by intercepting the coins of different denominations at spaced positions around the guide plate and removing the intercepted coins from between the guide plate and the resilient surface at said spaced positions.

31. A coin handling machine as set forth in claim 29 wherein said reference means is formed by a recessed area which forms an inner edge for engaging the inner edges of the coins depressed into said resilient surface and moving said coins radially outwardly.

32. A coin handling mechanism comprising a rotatably mounted coin-carrying disc having a resilient top surface onto which coins may be fed, means for rotating said disc, and a guide plate having a central opening to permit coins to pass therethrough and a configured lower surface positioned over and closely adjacent to said disc, and wherein said configured surface includes an arcuate recess adjacent to said central opening and within which coins are free to move radially, said arcuate recess extending outwardly from said central opening and having an outer edge along which coins form in a single file, said guide plate forming a capturing surface which is close enough to said resilient surface to press coins of all denominations into said resilient surface to inhibit radial movement of said coins, said capturing surface intercepting the outer edge of said arcuate recess and extending inwardly therefrom, and referencing means for engaging the inner edge of each of the advancing coins and positioning the engaged edges of said coins at a common radial location which is close enough to the outer periphery of at least a portion of said guide plate that a radially outer portion of each coin extends beyond said outer periphery while a radially inner portion of each coin remains gripped between said guide plate and said resilient surface, the radial positions of the outer edges of said coins being determined by the respective diameters of said coins.

33. A coin sorter for sorting coins in terms of their diameter comprising a rotatably mounted coin-carrying disc having a resilient top surface onto which coins may be fed, a guide plate having a central opening to permit coins to pass therethrough and a configured lower surface positioned over and closely adjacent to said disc, and wherein said configured surface includes an arcuate recess within which coins are free to move radially, said arcuate recess extending outwardly from said central opening and having an outer edge along which coins form in a single file, said guide plate forming a capturing surface which is close enough to said resilient surface to inhibit radial movement of said coins, said capturing surface intercepting the outer edge of said arcuate recess and extending inwardly therefrom, said capturing surface forming a referencing recess having a referencing edge for engaging the edge of each of the advancing coins engaged by said capturing surface and positioning said coin edges at a common radial location for coins of all denominations, whereby the diametrically opposite edge of each coin is positioned at a radial location determined by the diameter of the coin, said capturing surface also forming a plurality of exit recesses for guiding coins of different denominations outwardly to different circumferential locations around the periphery of said guide plate while continuing to press said coins into said resilient surface so that exiting coins are gripped between said guide plate and said resilient surface, regardless of where the coins are located along said exit recesses, counting means for counting the number of ejected coins of each denomination, and braking means for quickly stopping the rotation of said disc in response to a preselected count by said counting means.

34. A coin sorter for sorting coins in terms of their diameter comprising a rotatably mounted coin-carrying disc having a resilient top surface onto which coins may be fed, a guide plate having a central opening to permit coins to pass therethrough and a configured lower surface positioned over and closely adjacent to said disc, and wherein said configured surface includes an arcuate recess within which coins are free to move radially, said arcuate recess extending outwardly from said central opening and having an outer edge along which coins form in a single file, said guide plate forming a capturing surface which is close enough to said resilient surface to depress coins of all denominations into said resilient surface to inhibit radial movement of said coins, said capturing surface intercepting the outer edge of said arcuate recess and extending inwardly therefrom, a referencing recess formed in said capturing surface, one edge of said referencing recess positioning one edge of each of the advancing coins of each denomination at a predetermined radial location so that the diametrically opposite edge of each coin is positioned at a corresponding radial location determined by the diameter of the coin, the surface of said referencing recess being close enough to said resilient surface to press coins of all denominations into said resilient surface while the edges of said coins are being positioned at said predetermined radial locations, sorting means disposed around the outer periphery of said guide plate for sorting coins of different denominations according to said different radial locations of the radially outer edges of coins of different denominations, said sorting means ejecting coins of a common denomination at a common circumferential location on the periphery of said guide plate while continuously pressing said coins into said resilient surface, counting means for counting the number of ejected coins of each denomination, and braking means for quickly stopping the rotation of said disc in response to a preselected count by said counting means.

35. A coin sorter for sorting coins in terms of their diameter comprising:

a horizontally positioned circular coin-carrying disc having a resilient top surface onto which coins may be fed; and a guide plate having a central circular opening to permit coins to pass therethrough and a configured lower surface positioned over and closely adjacent to said disc, and wherein said configured surface includes an arcuate recess within which coins are free to move radially, and said arcuate recess extends outwardly from said central opening and has an outer edge along which coins form in a single file, said guide plate also forming a plurality of exit recess for guiding coins of different denominations outwardly to different circumferential locations around the periphery of said guide plate while continuously pressing said coins into said resilient surface so that exiting coins are gripped between said guide plate and said resilient surface, regardless of where the coins are located along said exit recesses.

36. A coin sorter for sorting coins in terms of their diameter comprising a rotatably mounted coin-carrying disc having a resilient top surface onto which coins may be fed, means for rotating said disc, a guide plate having a central opening to permit coins to pass therethrough and a configured lower surface positioned over and closely adjacent to said disc, and wherein said configured surface includes an arcuate recess within which coins are free to move radially, said arcuate recess extending outwardly from said central opening and having an outer edge along which coins form in a single file, said guide plate forming a capturing surface which is close enough to said resilient surface to press coins of all denominations into said resilient surface to inhibit radial movement of said coins, said capturing surface intercepting the outer edge of said arcuate recess and extending inwardly thereform for receiving and capturing coins from said arcuate recess, referencing means associated with said capturing surface for engaging one edge of each of the advancing coins of each denomination and radially moving each engaged coin to a predetermined radial location while said coins are pressed into said resilient surface, and multiple sorting means for sorting coins of different denominations according to the radial locations of the edges of said coins and discharging coins of different denominations at different circumferential locations around the periphery of said guide plate.

37. A coin sorter for sorting coins in terms of their diameter comprising a rotatably mounted coin-carrying disc having a resilient top surface onto which coins may be fed, means for rotating said disc, a guide plate having a central opening to permit coins to pass therethrough and a configured lower surface positioned over and closely adjacent to said disc, and wherein said configured surface includes an arcuate recess adjacent to said central opening and within which coins are free to move radially, said arcuate recess extending outwardly from said central opening having an outer edge along which coins form in a single file, said guide plate forming a capturing surface which is close enough to said resilient surface to press coins of all denominations into said resilient surface to inhibit radial movement of said coins, said capturing surface intercepting the outer edge of said arcuate recess and extending inwardly thereform for receiving and capturing coins from said arcuate recess, referencing means for engaging at least certain of the advancing coins pressed into said resilient surface by said capturing surface and radially moving the engaged coin edge to a predetermined radial location, while the engaged coins continue to be pressed into said resilient surface by said guide plate, so that the diametrically opposite edge of the engaged coins are positioned at a corresponding radial location determined by the diameter of the coin, and multiple sorting means for sorting coins of different denominations according to the radial locations of the edges of said coins and discharging coins of different denominations at different circumferential locations around the periphery of said guide plate.

38. A coin sorter for sorting coins in terms of their diameter comprising a rotatably mounted coin-carrying disc having a resilient top surface onto which coins may be fed, means for rotating said disc, a guide plate having a central opening to permit coins to pass therethrough and a configured lower surface positioned over and closely adjacent to said disc, and wherein said configured surface includes an arcuate recess adjacent to said central opening and within which coins are free to move radially, said arcuate recess extending outwardly from said central opening and having an outer edge along which coins form in a single file, said guide plate forming a capturing surface which is close enough to said resilient surface to press coins of all denominations into said resilient surface to inhibit radial movement of said coins, said capturing surface intercepting the outer edge of said arcuate recess and extending inwardly thereform for receiving and capturing coins from said arcuate recess, a referencing recess formed in said capturing surface and forming an arcuate edge which engages the inner edge of each of the advancing coins of each denomination and positions the engaged coin edges at predetermined radial locations so that the outer edge of each coin is positioned at a corresponding radial location determined by the diameter of the coin, and multiple sorting means receiving coins positioned by said referencing means and sorting coins of different denominations according to the radial locations of said outer edges, said sorting means ejecting coins of a common denomination at a common circumferential location on the periphery of said guide plate.

39. A coin sorter as set forth in claim 38 wherein said sorting means ejects coins of a maximum diameter first and then coins of progressively smaller diameters.

* * * * *